US009132930B2

(12) United States Patent
Tavernari et al.

(10) Patent No.: US 9,132,930 B2
(45) Date of Patent: Sep. 15, 2015

(54) DEVICE AND METHOD FOR FEEDING A WEB OF A PACKAGING MATERIAL

(75) Inventors: Fabrizio Tavernari, Nonantola (IT); PierPaolo Algeri, Rubiera (IT); Enrico Lotti, Soliera (IT); Marco Carreri, Modena (IT); Daniele Palladino, Scandiano (IT); Davide Andreotti, Soliera (IT); Marco Ricco', Spilamberto (IT); Luca Leonardi, Castellarano (IT); Giuseppe Esposito, Sasso Marconi (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 701 days.

(21) Appl. No.: 13/519,963

(22) PCT Filed: Feb. 12, 2011

(86) PCT No.: PCT/EP2011/052082

§ 371 (c)(1),
(2), (4) Date: Jun. 29, 2012

(87) PCT Pub. No.: WO2011/098591

PCT Pub. Date: Aug. 18, 2011

(65) Prior Publication Data

US 2012/0272619 A1 Nov. 1, 2012

(30) Foreign Application Priority Data

Feb. 12, 2010 (EP) ..... 10153478

(51) Int. Cl.
*B65B 41/18* (2006.01)
*B65B 61/18* (2006.01)
*B31B 1/90* (2006.01)

(52) U.S. Cl.
CPC . *B65B 41/18* (2013.01); *B31B 1/90* (2013.01); *B65B 61/18* (2013.01); *B31B 2201/0205* (2013.01); *B31B 2201/9023* (2013.01)

(58) Field of Classification Search
CPC ..... B65B 41/18; B65B 61/18; B31B 1/90; B31B 2201/0205; B31B 2201/9023
See application file for complete search history.

(56) References Cited

U.S. PATENT DOCUMENTS 4,782,987 A 11/1988 Giacomelli et al.
5,568,718 A 10/1996 Lerner et al.

(Continued)

FOREIGN PATENT DOCUMENTS

CN 1240380 A 1/2000
CN 1306934 A 8/2001

(Continued)

OTHER PUBLICATIONS

Office Action (Decision to Grant) issued on Mar. 13, 2015, by the Russian Patent Office in corresponding Russian Patent Application No. 2012138956/13, and the English translation of the Office Action. (15 pages).

(Continued)

*Primary Examiner* — Robert B Davis
(74) *Attorney, Agent, or Firm* — Buchanan Ingersoll & Rooney PC

(57) ABSTRACT

A device for feeding a web of a packaging material along a path and towards an application station; wherein the packaging material comprises a plurality of pre-laminated holes at which application station applies respective opening devices. The device comprises an advancing mechanism for advancing the web along a first direction parallel to path; a sensor for generating a plurality of measure signals associated to the positions of pre-laminated holes; and a first motor controllable on the basis of measure signals. The first motor is operatively connected to the advancing mechanism for moving the advancing mechanism along a second direction transversal to path.

19 Claims, 6 Drawing Sheets

(56) References Cited

U.S. PATENT DOCUMENTS

| | | | |
|---|---|---|---|
| 6,195,967 | B1 | 3/2001 | Todd et al. |
| 6,303,066 | B1 | 10/2001 | Gustafsson et al. |
| 6,386,851 | B1 | 5/2002 | Gustafsson |
| 2002/0028270 | A1 | 3/2002 | Gustafsson et al. |
| 2004/0038789 | A1 | 2/2004 | Succi et al. |
| 2004/0169066 | A1 | 9/2004 | Palm |
| 2008/0315452 | A1 | 12/2008 | Martini et al. |

FOREIGN PATENT DOCUMENTS

| | | | |
|---|---|---|---|
| CN | 1440348 | A | 9/2003 |
| CN | 1525923 | A | 9/2004 |
| EP | 0230986 | A2 | 8/1987 |
| EP | 1110867 | A1 | 6/2001 |
| EP | 1122169 | A1 | 8/2001 |
| EP | 1170217 | A1 | 1/2002 |
| EP | 1813410 | A1 | 8/2007 |
| RU | 2 344 055 | C2 | 1/2009 |
| WO | WO 98/18608 | A1 | 5/1998 |

OTHER PUBLICATIONS

*International Search Report (PCT/ISA/210) issued on May 19, 2011, by the European Patent Office as the International Searching Authority for International Application No. PCT/EP2011/052082.

*Written Opinion (PCT/ISA/237) issued on May 19, 2011, by the European Patent Office as the International Searching Authority for International Application No. PCT/EP2011/052082.

Chinese Office Action dated Jul. 26, 2013, issued by the Chinese Patent Office in corresponding Chinese Patent Application No. 201180009039.4, and partial English language translation of Office Action. (8 pages).

DEVICE AND METHOD FOR FEEDING A WEB OF A PACKAGING MATERIAL

TECHNICAL FIELD

The present invention relates to a device and to a method for feeding a web of a packaging material along a path and towards an application station, which applies, in use, a plurality of opening devices onto respective areas of the packaging material.

BACKGROUND ART

As is known, many pourable food products, such as fruit juice, UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may comprise a layer of fibrous material, e.g. paper, or mineral-filled polypropylene material, and a number of lamination layers of heat-seal plastic material, e.g. polyethylene films, covering both sides of the base layer.

In the case of aseptic packages for long-storage products, such as UHT milk, the packaging material also comprises a layer of gas-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

To open the packages described above, various solutions of opening devices have been proposed.

A first solution of opening device comprises a patch defined by a small sheet of a heat-seal plastic material, and which is heat sealed over a respective hole on the side of the web eventually forming the inside of the package; and a pull-off tab applied to the opposite side of the packaging material and heat sealed to the patch. The tab and patch adhere to each other, so that, when the tab is pulled off, the portion of the patch heat sealed to it is also removed to uncover the hole.

Alternatively, a second solution comprises closable opening devices which are applied by injecting plastic material directly onto the holes of the web. In this case, the application station is a molding station.

Finally, a third solution of opening device comprises a frame defining an opening and fitted about a pierceable or removable portion of the packaging material.

The pierceable portion of the package may be defined by a so-called "prelaminated" hole, i.e. a hole formed in the base layer only and covered by the other lamination layers, including the layer of gas-barrier material. Also in this case, the application station is a molding station.

More precisely, web is provided with a plurality of prelaminated holes in a packaging material factory and then fed to the packaging machine.

Web is then wound off from a reel within the packaging machine. Subsequently, web is stepwise fed to the application station before that the packaging material is folded to form a tube. In particular, the web is fed towards the molding station along a first direction.

The molding of opening devices at the molding station requires that pre-laminated holes are fed in a correct position relative to the molding station.

However, due to several reasons, among which for example misalignments within the reel, the real positions of pre-laminated holes may differ from the theoretical positions, which are required for a correct molding of the opening device at the molding station.

Accordingly, it is necessary to adjust the position of the web before it reaches the molding station.

EP-A-122169 in the name of the same Applicant discloses a device for adjusting the position of the web of the packaging material on a packaging machine along a second direction, which is transversal to the first direction.

In greater detail, the web of packaging material is fed through the machine along a path defined by a plurality of drive or transmission rollers. The path is, in particular, parallel to the first direction.

The device comprises a slide movable along the second direction, a gripping member for gripping and moving the web in the second direction, and a motor for controlling the slide.

Device also comprises a pair of sensors for detecting the position of the web, and a control unit connected to the sensors and which controls the motor to move the slide along the second direction in response to the values detected by the sensors.

Due to the fact that it is at the same time both supported by fixed rollers and moved by gripping member relative to the rollers, the packaging material is subjected to stress and therefore may be damaged.

A need is felt within the industry to feed the application station with the packaging material having the areas at which the opening devices will be applied in the correct position while reducing the risk of damaging the packaging material.

Furthermore, the gripping member of the device disclosed in EP-A-122169 comprises a supporting plate hinged to the slide. The plate is fitted with an arm supporting a shoe cooperating in use with an edge of the web. The gripping member is subjected to the elastic force of a low-stiffness spring stretched between a fastening member and an auxiliary arm projecting transversely from plate. Plate also supports two shafts, which are fitted with idler rollers rolling on opposite side of web. Accordingly, gripping member is, in use, tilted forwards in a position defined by a balance between the action of the spring, the reaction of web onto shoes, and the frictional force between moving web and rollers.

A need is also felt within the industry to feed the application station with the packaging material having the areas at which the opening devices will be applied in the correct position while reducing the number of the overall components of the device.

DISCLOSURE OF INVENTION

It is an object of the present invention to provide a device for feeding a web of a packaging material along a path and towards an application station, designed to meet at least one of the above-identified requirement.

According to the present invention, there is provided a device for feeding a web of a packaging material along a path and towards an application station, as claimed in claim 1.

The present invention also relates to a method for feeding a web of a packaging material along a path and towards an application station, as claimed in claim 9.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
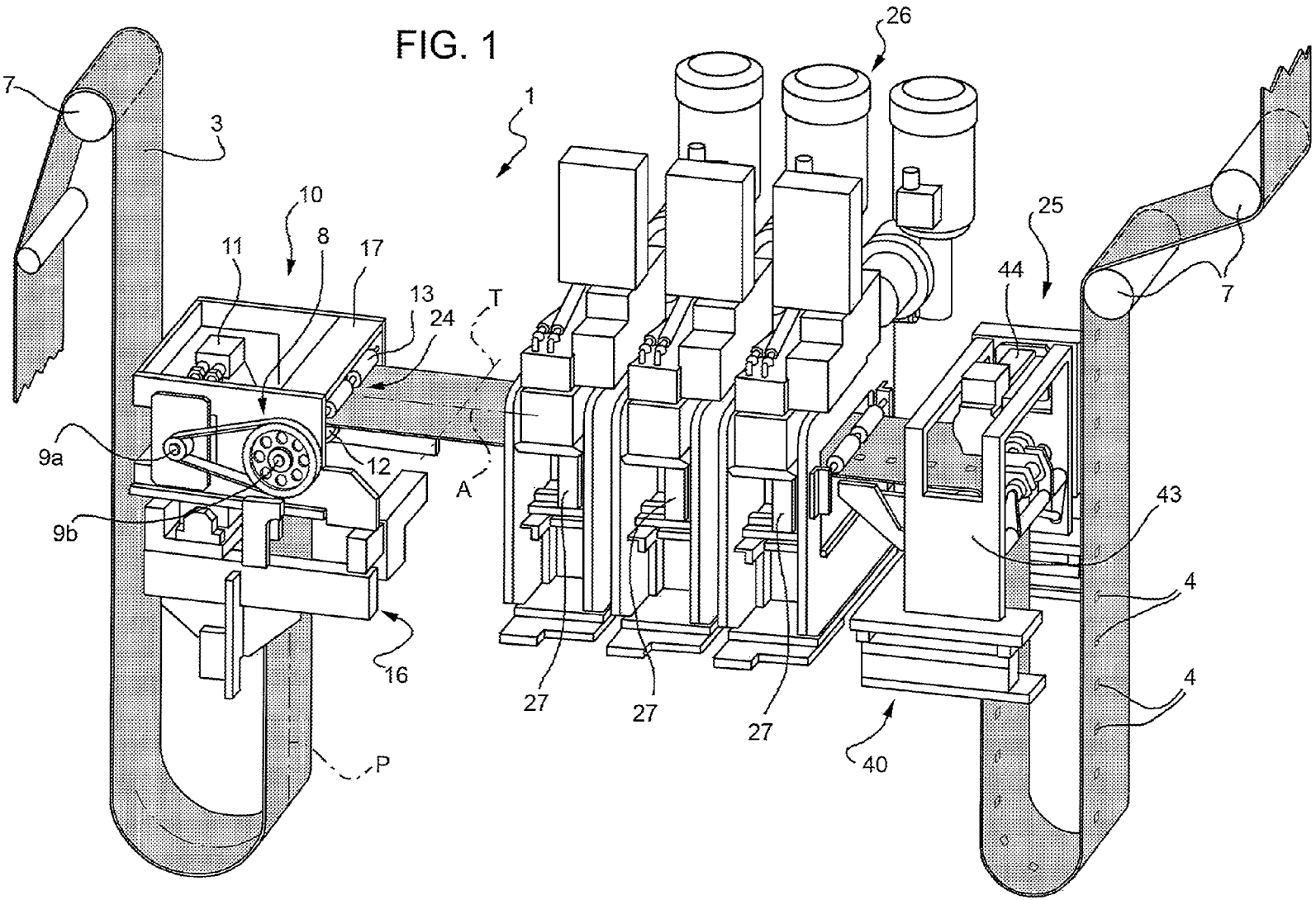
FIG. 1 shows a perspective view of a unit for molding a plurality of opening devices onto respective pre-laminated holes of a web of a packaging material, comprising a device for feeding the molding station according to the present invention.

Number 1 in FIG. 1 indicates as a whole a unit for molding a plurality of opening devices 4 onto respective pre-laminated holes of a web 3 of a packaging material.

Packaging material is intended to form a plurality of packages, which preferably contain a pourable food product, such as pasteurized or UHT milk, fruit juice, wine, etc.

Packages may also contain a food product, which is pourable within a tube of packaging material when producing packages, and sets after packages are sealed. One example of such a food product is a portion of cheese, which is melted when producing packages and sets after packages are sealed.

The tube is formed in known manner downstream from unit 1 by longitudinally folding and sealing a known web 3 of heat-seal sheet material, which comprises a layer of paper material covered on both sides with layers of heat-seal plastic material, e.g. polyethylene. In the case of an aseptic package for long-storage products, such as UHT milk, the packaging material comprises a layer of oxygen-barrier material, e.g. aluminium foil, which is superimposed on one or more layers of heat-seal plastic material eventually forming the inner face of package contacting the food product.

The tube of packaging material is then filled with the food product for packaging, and is sealed and cut along equally spaced cross sections to form a number of pillow packs (not shown), which are then transferred to a folding unit where they are folded mechanically to form respective packages.

A first solution of opening device 4 comprises a patch defined by a small sheet of a heat-seal plastic material, and which is heat sealed over a respective hole on the side of the web eventually forming the inside of the package; and a pull-off tab applied to the opposite side of the packaging material and heat sealed to the patch. The tab and patch adhere to each other, so that, when the tab is pulled off, the portion of the patch heat sealed to it is also removed to uncover the hole.

Alternatively, a second solution comprises closable opening device 4 which are applied by injecting plastic material directly onto the holes of the web 3.

In a third solution, web 3 comprises a number of removable portions (not shown in the Figures) equally spaced in a lengthwise direction A of the packaging material, and to which opening devices 4 are injection molded.

In the embodiment shown, removable portion is defined by a so-called pre-laminated hole, i.e. a hole (or opening) formed through base layer of packaging material and covered by lamination layers so that hole is sealed by a respective sheet cover portion.

Figure 6:
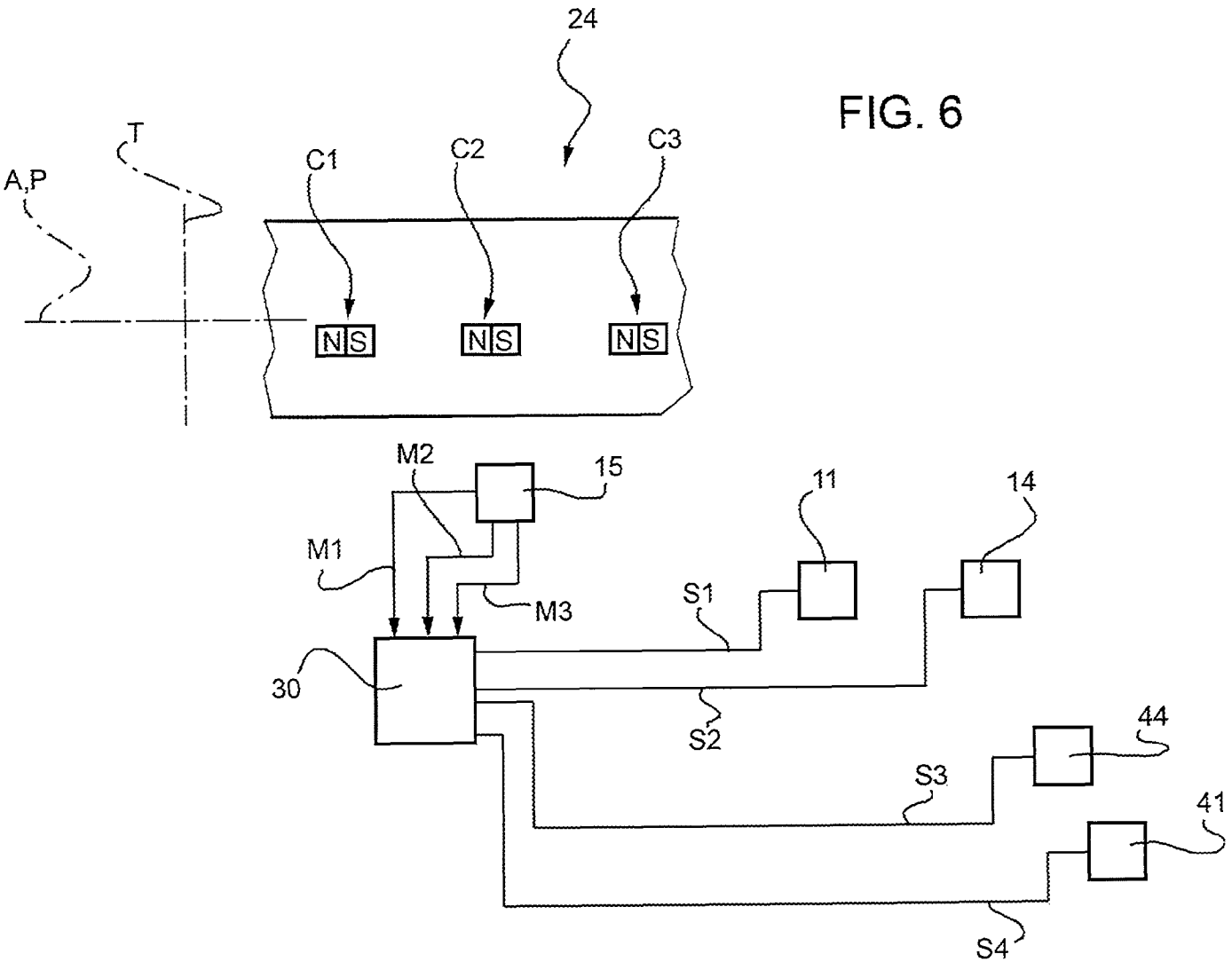
FIG. 6 schematically shows some components of the unit of FIG. 1.

Web 3 finally comprises a plurality of magnetic markers C1, C2, C3 (shown in FIG. 6 for sake of clarity, but not visible in reality).

In the embodiment shown, magnetic markers C1, C2, C3 are printed with a magnetizable ink which has been subsequently magnetized. More precisely, each magnetic marker C1, C2, C3 has respective north and south poles aligned along path P.

Magnetic markers C1, C2, C3 are applied to web 3 in alignment with pre-laminated holes.

Unit 1 substantially comprises (FIG. 1):

- a device 10 arranged downstream from the reel and adapted to advance web 3 along direction A which is parallel to path P;
- a molding station 26 stepwise fed with web 3 by device 10 and adapted to injection mould a plurality opening devices 4, three in the embodiment shown, onto web 3 and at respective pre-laminated holes of web 3; and
- a device 25 arranged downstream from the molding station 20 along path P and adapted to advance web 3 along direction A.

Unit 1 also comprises a plurality of idler rollers 7 which are arranged upstream from device 10 and downstream from device 25 and are adapted to support web 3 while it advances along path P.

More precisely, device 10 stepwise feeds one after the other a plurality of portions 24 of web 3 each comprising a certain number of pre-laminated holes, three in the embodiment shown, towards molding station 26; and molding station 26 comprises a plurality, three in the embodiment shown, of moulds 27, which inject the plastic material forming respective opening devices 4 onto web 3 and at respective pre-laminate holes.

More precisely, each portion 24 comprises, proceeding from device 10 towards molding station 26, a first, a second and a third pre-laminated hole which are associated respectively to magnetic markers C1, C2, C3. In particular, the positions of magnetic markers C1, C2, C3 are associated to the positions of first, second and third pre-laminated holes.

In greater detail, device 10 comprises (FIGS. 2 to 4):

- a motor 11 for horizontally and stepwise advancing web 3 along direction A;
- a plurality of rollers 12 and counter-rollers (not shown) for guiding web 3 along direction A;

a pair of rollers 13 for damping the oscillations of web 3 in a vertical plane;

a magnetic sensor 15 for detecting the positions of magnetic markers C1, C2, C3 of web 3 and generating respective measure signals M1, M2, M3 associated to the real position of the first, second and third pre-laminated holes; and a motor 14 controllable on the basis of measure signals M1, M2, M3.

Roller 12 is driven in rotation by motor 11 through the interposition of a belt 8. More precisely, belt 8 is wound onto a pulley 9*a* driven in rotation by motor 11 and a pulley 9*b* which drives in rotation roller 12.

Roller 12 and corresponding counter-roller cooperate with opposite sides of web 3 which is being advanced towards molding station 26.

Motor 14 is advantageously operatively connected to motor 11 and rollers 12 for moving them along a direction T transversal to path P and direction A. In particular, direction T is orthogonal to direction A and is arranged, in use, horizontally.

Sensor 15, in the embodiment shown, detects the transition between respective north and south pole of magnetic markers C1, C2, C3, so detecting the positions of magnetic markers C1, C2, C3, and, therefore, the positions of relative first, second and third pre-laminated holes along direction A. Furthermore, sensor 15 detects the intensity of the magnetic field generated by magnetic markers C1, C2, C3, so detecting the relative positions of magnetic markers C1, C2, C3 and, therefore, the positions of relative first, second and third pre-laminated holes along direction T.

In greater detail, device 10 comprises:

a fixed frame 16 supporting motor 14 and sensor 15;

a structure 17 which is movable relative to frame 16 along direction T, and carries motor 11, rollers 12 and respective counter-rollers.

Figure 4:
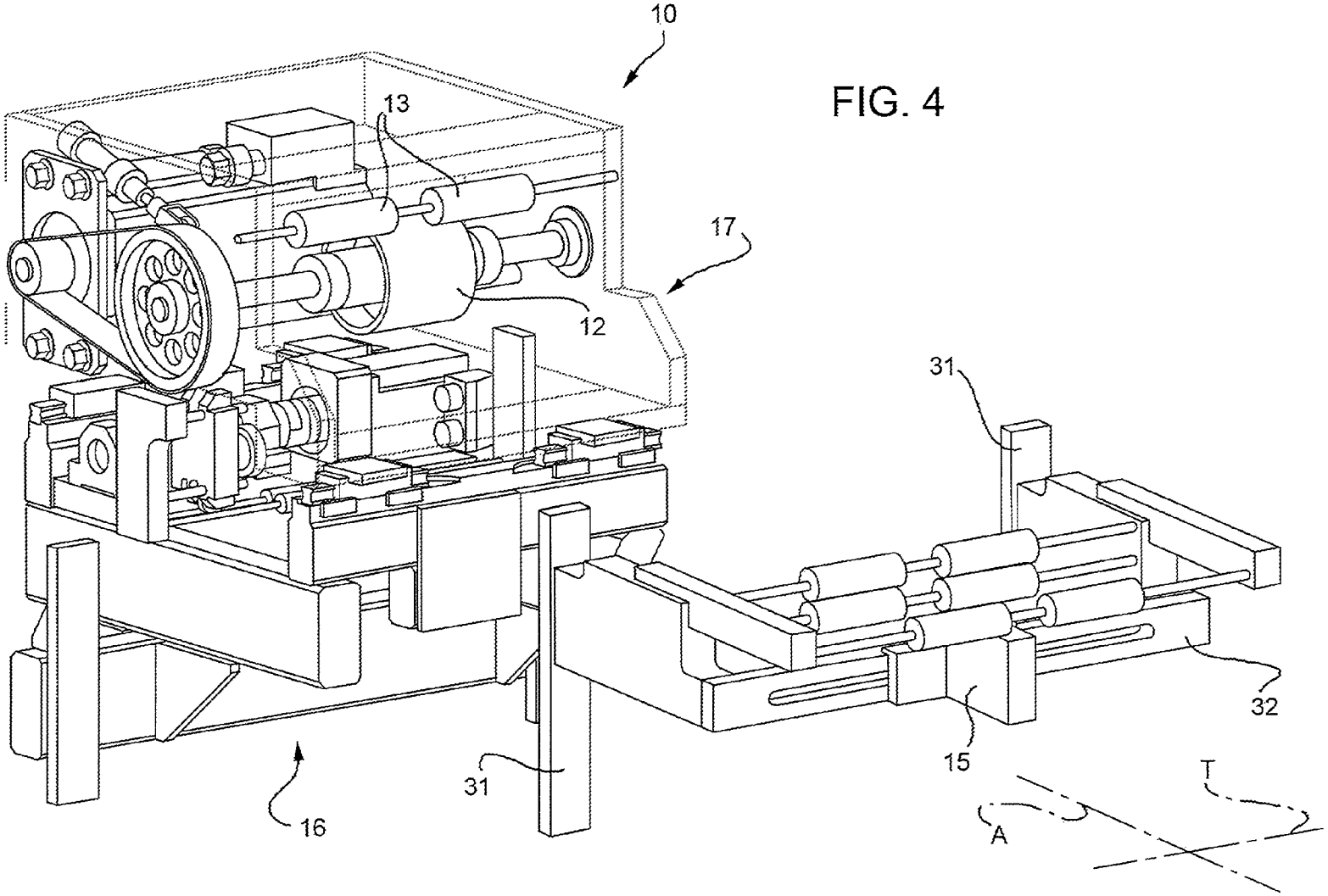
FIG. 4 shows an enlarged perspective view of additional particulars of the device of FIG. 1.

Frame 16, in particular, supports a pair of elements which are arranged on respective opposite sides of structure 17 along direction T and are connected by a crossbar 32 (FIG. 4).

Sensor 15 generates measure signals M1, M2, M3, which are associated to the real positions of first, second and third pre-laminated hole corresponding to respective magnetic markers C1, C2, C3 along directions A and T.

Unit 1 also comprises (FIG. 3):

a roller screw 19 driven in rotation about direction T by motor 14;

a female screw 20 screwed to screw 19, so as to move along direction T when screw 19 rotates about direction T; and a plate 21 connected to screw 20 and to structure 17 in a not shown way.

Figure 2:
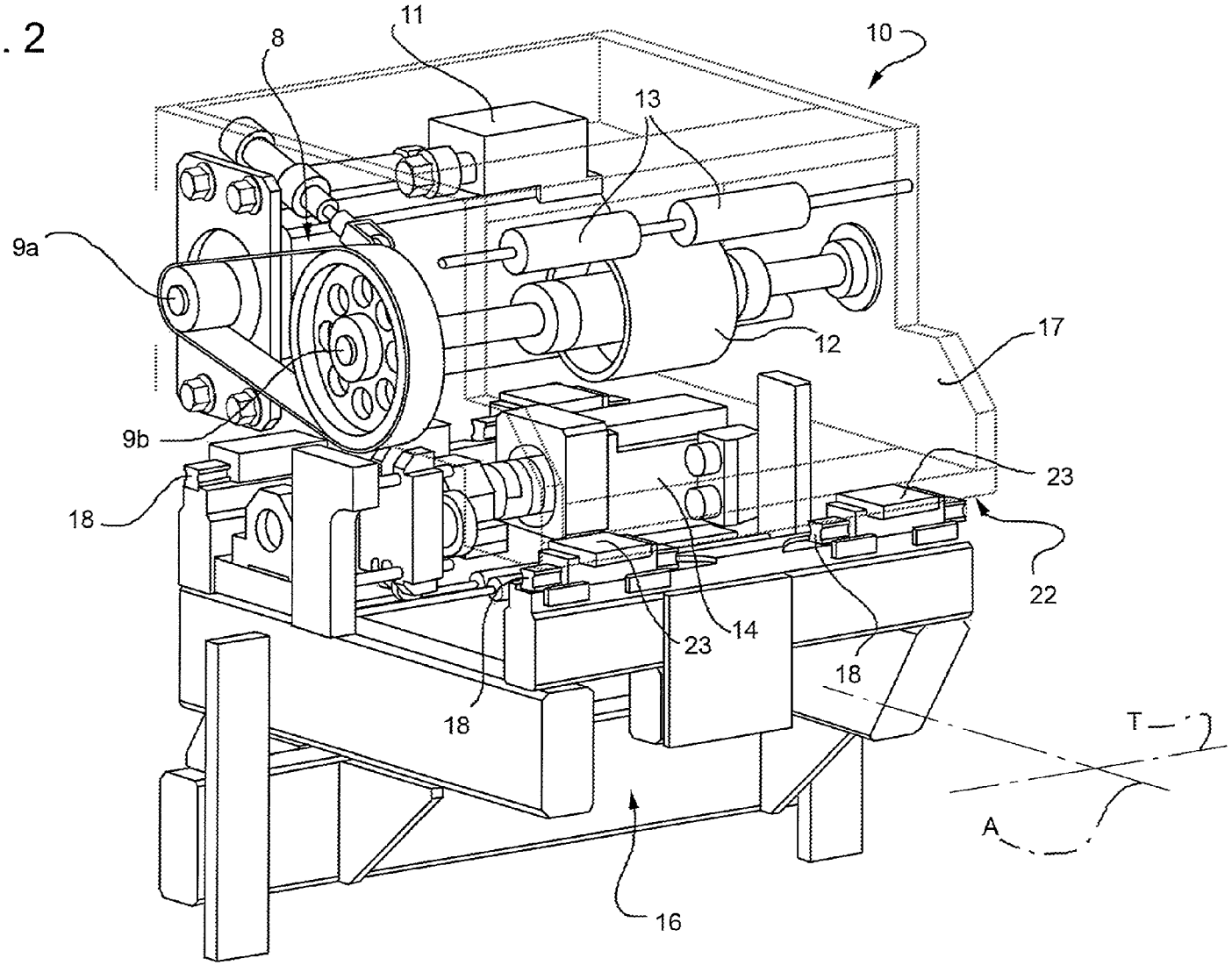
FIG. 2 shows an enlarged perspective view of the device of FIG. 1, with parts removed for clarity.
Figure 3:
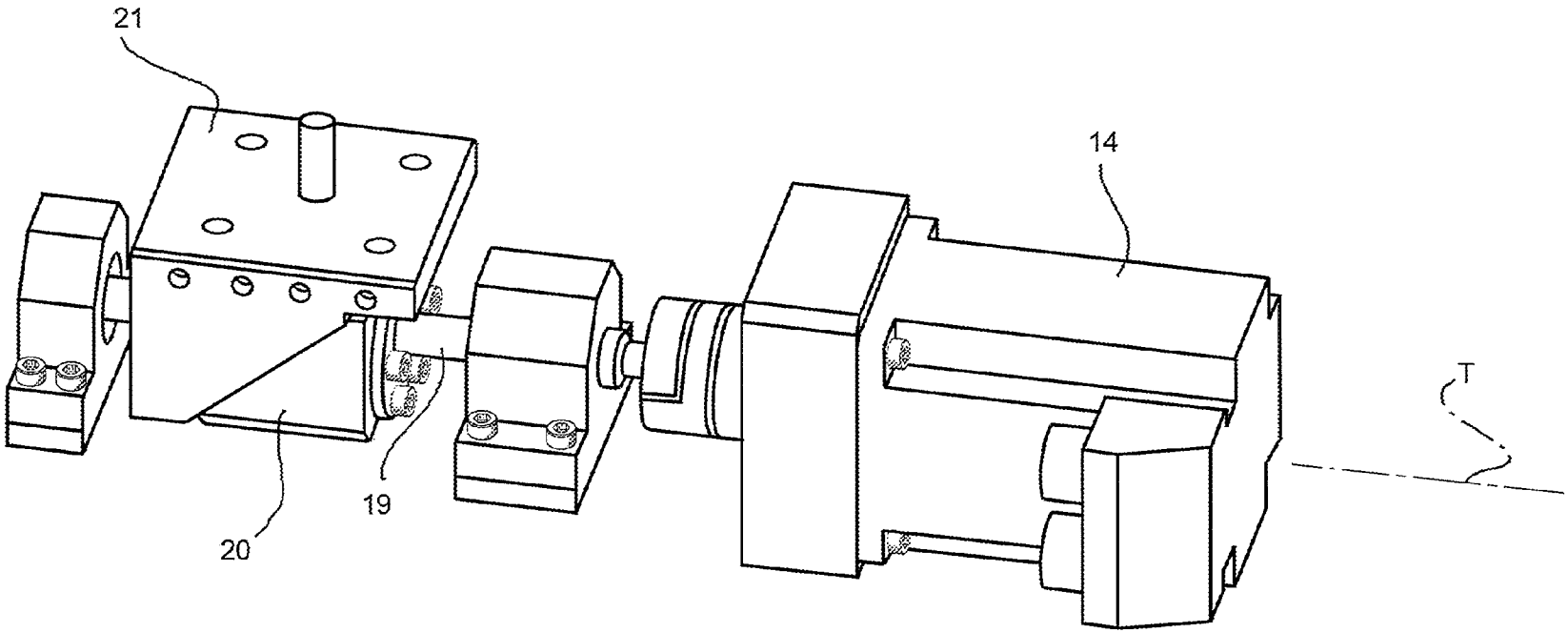
FIG. 3 shows a further enlarged perspective view of some particular of the device of FIG. 1.

A bottom wall 22 of structure 17 comprises a plurality of slides 23 which may slide along direction T over respective guides 18 fixed with respect to frame 16 (FIG. 2).

Unit 1 also comprises a control unit 30 (only schematically shown in FIG. 6) which receives measure signals M1, M2, M3 from sensor 15 and generates control signals S1, S2 for motors 11, 14.

In particular, control unit 30 has stored in memory the theoretical positions of pre-laminated holes with respect to moulds 27, and evaluates the difference between the detected position of first, second and third pre-laminated holes and the respective theoretical positions.

Control signal S1 for motor 11 results in an additional displacement of web 3 along direction A.

Accordingly, motor 11 moves web 3 along direction A for a length which is the algebraic sum of the additional displacement depending on control signal S1 and of a nominal constant displacement.

More precisely, the additional displacement of web 3 along direction A generated by control signal S1 is associated to the difference between the detected position and the theoretical position of only one, namely the second, pre-laminated hole.

Control signal S2 for motor 14 results in a displacement of web 3 along direction T and is generated in the following way.

More precisely, control unit 30 evaluates for each first, second and third pre-laminated holes of portion 24, the distance between the theoretical and the detected position; and evaluates the maximum and the minimum value of said distances. Control unit 30 then generates control signal S2 which causes displacement of web 3 along direction T equal to the average between the maximum and the minimum value.

In other words, the distance between the theoretical and detected positions of the pre-laminated hole which is different from the maximum and the minimum value is neglected.

Device 25 comprises (FIG. 5):

a fixed frame 40 comprising a plurality of guides 42 which extend along direction T;

a motor 41 supported by frame 40 in a fixed position relative to direction T;

a structure 43 movable relative to frame 40 and motor 41 along direction T; and a motor 44 (shown in FIG. 1) fitted to structure 43 and adapted to advance web 3 along direction A and on the opposite side of molding station 26.

Figure 5:
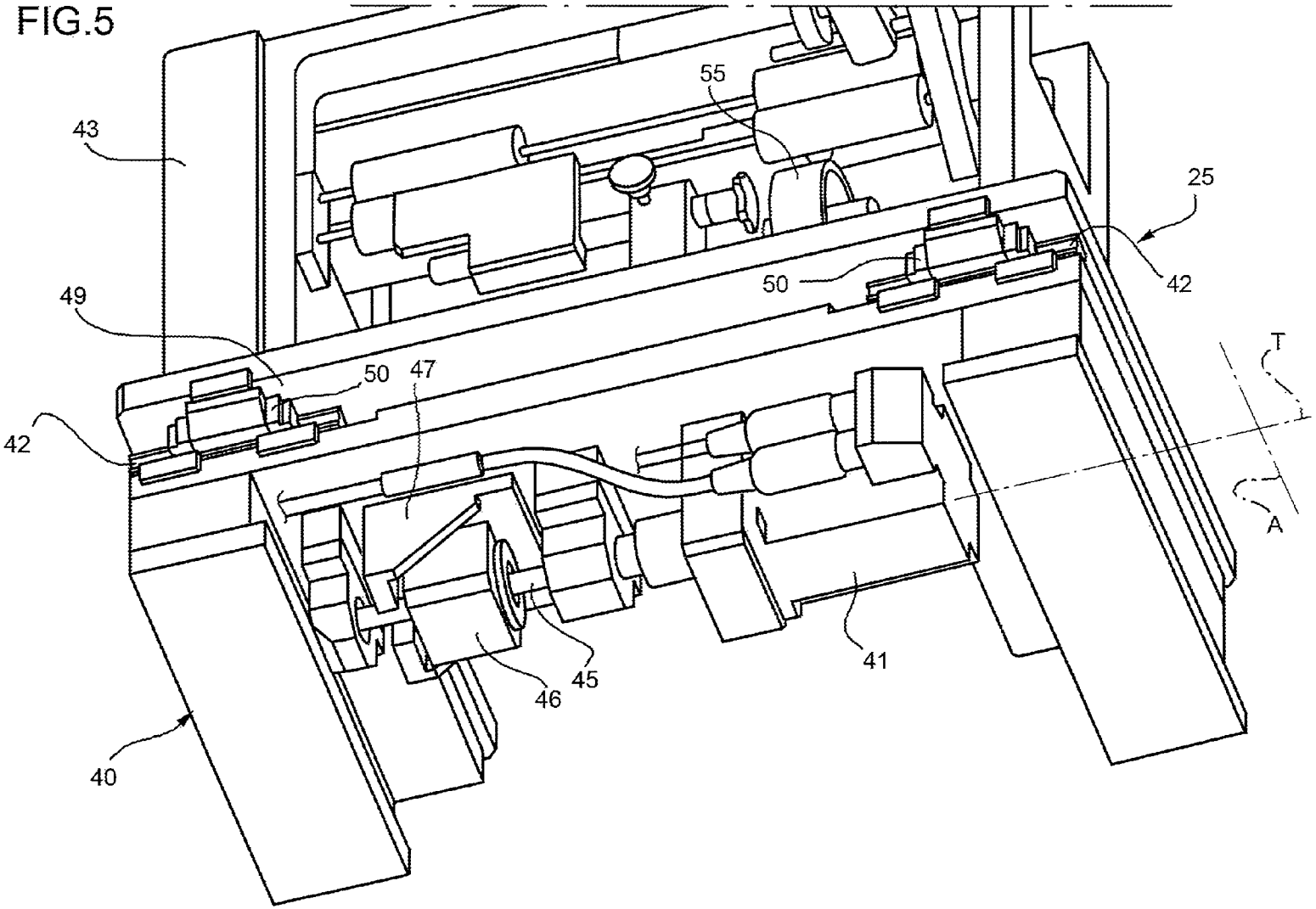
FIG. 5 shows an enlarged perspective view of an additional device of the unit of FIG. 1.

Device 25 also comprises a pair of rubber wheels 55 (only one shown of which is shown in FIG. 5) for guiding web 3 along direction A and driven in rotation by motor 44 through the interposition of a belt. More precisely, the belt is wound onto a first pulley driven in rotation by motor 44 and a second pulley which drives in rotation wheels 55.

Motor 41 moves structure 43 and, therefore, motor 44 along direction T, so that also web 3 moves along direction T.

To this purpose, motor 41 is operatively connected to structure 43 through the interposition of:

a roller screw 45 driven in rotation about direction T by motor 41;

a female screw 46 screwed to screw 45, so as to move along direction T when screw 45 rotates about direction T; and a plate 47 connected to screw 46 and to a bottom plate 49 (in a not-shown way) of structure 43.

Bottom plate 49 of structure 43 comprises a plurality of slides 50 which may slide along direction T over respective guides 42.

Motors 41 and 44 are controlled by control unit 30 on the basis of the measured signals M1, M2, M3 generated by sensor 15.

More precisely, control unit 30 generates a control signal S3 for motor 44 which results in an additional displacement of web 3 along direction A.

Accordingly, motor 44 moves web 3 along direction A for a length which is the algebraic sum of the additional displacement depending on control signal S3 and of a nominal constant displacement.

More precisely, the additional displacement of web 3 along direction A generated by control signal S3 is associated to the difference between the detected position and the theoretical position of only one, namely the second, pre-laminated hole.

Control signal S4 for motor 14 results in a displacement of web 3 along direction T and is generated in the following way.

More precisely, control unit 30 evaluates for each first, second and third pre-laminated holes of portion 24, the distance between the theoretical and the detected position; and evaluates the maximum and the minimum value of said distances. Control unit 30 then generates control signal S4 which causes displacement of web 3 along direction T equal to the average between the maximum and the minimum value.

In other words, the distance between theoretical and detected positions of pre-laminated hole which is different from the maximum and the minimum value is neglected.

Motors 11, 44 move web 3 for the same length along direction A. More precisely, motor 44 pulls web 3 along path P and towards moulds 27 while motor 11 provides web 3 with the correct level of tension.

Motors 14, 41 move respective structures 17, 43 and, therefore, web 3 for the same length along direction T.

In other words, motors 11, 44; 14, 41 are synchronized.

The operation of device 10 and of unit 1 will be hereinafter described with reference to only one portion 24 and to the relative first, second and third pre-laminated holes and corresponding magnetic markers C1, C2, C3.

Web 3 provided with pre-laminated holes and magnetic markers C1, C2, C3 is wound off from reel 3 along path P.

Devices 10, 25 stepwise and horizontally move web 3 through molding station 26, and moulds 27 inject plastic material forming respective opening devices 4 onto web 3 and at respective pre-laminated holes.

Sensor 15 detects the presence of magnetic markers C1, C2, C3 and generates measure signals M1, M2, M3 which are associated to the real position of corresponding first, second and third pre-laminated holes along directions A, T.

Control unit 30 receives measured signals M1, M2, M3; evaluates the differences between real and theoretical positions of first, second and third pre-laminated holes along directions A, T; and generates control signals S1, S2, S3, S4 for motors 11, 14; 44, 41.

In particular, motors 11 and 44 move web 3 along direction A for the same length and at the same time. More precisely, motor 44 pulls web 3 along path P and towards moulds 27 while motor 11 provides web 3 with the correct level of tension.

Control signal S1 is associated to the difference between the detected and the theoretical position of the second pre-laminated hole along direction A.

Motor 11 advances web 3 along direction A for a length which is the algebraic sum of the nominal displacement and of the additional displacement depending on control signal S1.

Motor 14 displaces web 3 along direction T for a length which is determined by control signal S2 generated by control unit 30.

In particular, control unit 30:

- evaluates for each first, second and third pre-laminated holes of portion 24, the distance between the theoretical and the detected position;
- evaluates the maximum and the minimum value of said distances; and
- generates control signal S2 which causes displacement of web 3 along direction T equal to the average between the maximum and the minimum value.

Motor 14 is controlled by control signal S2 and rotates roller screw 19 about direction T, so causing the translation of screw 20, plate 21 and whole structure 17 along this direction T.

More precisely, as plate 21 moves along direction T, slides 23 slide over respective guides 18 along such direction T.

The displacement of structure 17 along direction T causes the movement of motor 11, rollers 12 and, therefore, of web 3, along direction T up to arrange the first, second and third pre-laminated holes in the respective correct positions as they reach molding station 26.

As first, second and third pre-laminated holes reach molding station 26, respective moulds 27 inject plastic material onto web 3 so as to form corresponding opening devices 4 at relative pre-laminated holes.

Control signal S3 is associated to the difference between the detected and the theoretical position of the second pre-laminated hole along direction A.

Motor 44 advances web 3 along direction A for a length which is the algebraic sum of the nominal displacement and of the additional displacement depending on control signal S3.

Motor 41 displaces web 3 along direction T for a length which is determined by control signal S4 generated by control unit 30.

In particular, control unit 30:

- evaluates for each first, second and third pre-laminated holes of portion 24, the distance between the theoretical and the detected position;
- evaluates the maximum and the minimum value of said distances; and
- generates control signal S4 which causes displacement of web 3 along direction T equal to the average between the maximum and the minimum value.

Motor 41 rotates roller screw 45 about direction T, so causing the translation of screw 46, plate 47 and whole structure 43 along this direction T.

More precisely, as plate 47 moves along direction T, slides 50 slide over respective guides 42 along such direction T.

The movement of structure 43 causes the movement of motor 44 and wheels 55 and, therefore, of web 3, along direction T up to arrange pre-laminated holes in the respective correct positions as they reach molding station 26.

Since control signals S2, S4 are equal, motor 14, 41 move web 3 of the same length along direction T.

The advantages of device 10 and of the method according to the present invention will be clear from the foregoing description.

In particular, the operation of motor 14 results in the movement along direction T of motor 11, rollers 12 and, therefore, of web 3. Accordingly, the first, second and third pre-laminated holes of web 3 may be arranged in the correct position along direction T relative to corresponding moulds 27, so correcting possible misalignments of the pre-laminated holes within the reel.

Due to the fact that web 3 is substantially not moved relative to rollers 12 along direction T, the overall resulting stress on web 3 is highly reduced when compared with stresses resulting by the operation of the gripping member of the device disclosed in EP-A-122169 and referred to in the introductory part of the present description.

Furthermore, device 10 comprises neither a gripping member nor a mechanical group adapted to tilt the gripping member towards web 3. Accordingly, the overall design of the device 10 is rather simple when compared with the device disclosed in EP-A-122169.

Finally, motor 11, 44 are controlled by control signal S1, S3 so as to generate an additional movement of web 3 along direction A. Such additional movement arranges first, second and third pre-laminated hole in the correct position with respect to relative moulds 27 also along direction A.

Clearly, changes may be made to device 10 and to the method without, however, departing from the protective scope defined in the accompanying Claims.

The invention claimed is:

1. A device for feeding a web of a packaging material along a path and towards an application station; said packaging material comprising a plurality of areas at which said application station applies, in use, respective opening devices;

said device comprising:

advancing means for advancing said web along a first direction parallel to said path;

a sensor for generating a plurality of measure signals associated to positions of said areas; and a first motor controllable on the basis of at least one of said measure signals;

wherein said first motor is operatively connected to said advancing means for moving said advancing means along a second direction transversal to said path.

2. The device of claim 1, comprising a control unit which, in use, receives said measure signals from said sensor and generates, on the basis of at least one of said measure signals, a first control signal, for said first motor.

3. The device of claim 1, wherein said measure signals are associated to the positions of respective magnetic markers carried by said web;

the positions of said magnetic markers being associated to the positions of respective said areas.

4. The device of claim 2, said advancing means comprise a second motor for advancing said packaging material along said first direction; said second motor being controllable by using a second control signal which is generated by said control unit on the basis of at least one of said measure signals.

5. The device according to claim 1, comprising:

a fixed frame carrying said first motor; and a structure which is movable with respect to said frame along said second direction (T) and to which said advancing means are fitted.

6. A unit for applying a plurality of said opening devices onto said respective areas, comprising:

said application station;

a device according to claim 1 and which is arranged upstream from said application station with reference to an advancing direction of said packaging material along said path; and an additional device which is arranged downstream from said application station with reference to an advancing direction of said packaging material along said path;

said additional device comprising, in turn:

additional advancing means for advancing said web along said path; and a third motor operatively connected to said additional advancing means for moving said additional advancing means along said second direction.

7. The unit of claim 6, wherein said third motor is controllable by a third control signal generated by said control unit on the basis at least one between said measure signals and operatively connected to said additional advancing means for advancing said additional advancing means along said second direction.

8. The unit of claim 6, wherein said application station is a molding station, and said areas are pre-laminated holes at which said application station applies, in use, respective said opening devices.

9. A method for feeding a web of a packaging material along a path and towards an application station; said packaging material comprising a plurality of areas at which said application station applies respective opening devices;

said method comprising:

advancing said web along a first direction parallel to said path by using first advancing means;

detecting the positions of said areas; and generating a plurality of measure signals which are associated to positions of said areas;

transversally moving, on the basis of at least one of said measured signal, said first advancing means along a second direction transversal to said path.

10. The method according to claim 9, wherein said generating comprises detecting the positions of a plurality of magnetic markers which are carried by said web and are associated to the positions of said areas.

11. The method of claim 9, wherein said advancing comprises stepwise advancing a portion of said web having a given number of areas;

said generating comprising:

evaluating a difference between the detected and the theoretical positions of each areas of said given number; and evaluating maximum and minimum values of said differences;

said transversally moving comprising moving said advancing means along said second direction and on the basis of an average value between the maximum and minimum values of said differences.

12. The method of claim 11, wherein said advancing comprises advancing said web on the basis of at least one of said measured signals.

13. The method of claim 9, wherein said advancing comprises the advancing said web on the basis of at least one of said measured signals.

14. The method of claim 12, wherein said advancing is carried out on the basis of a difference between the detected position and the theoretical position of only one area of said given number.

15. A method for applying a plurality of said opening devices onto said respective areas, comprising:

the method for feeding according to claim 9 upstream from said application station;

further advancing said web along said path downstream from said application station by using additional advancing means; and transversally moving, on the basis of said measured signals, said additional advancing means along said second direction transversal to said path.

16. The method of claim 15, wherein said transversally moving said advancing means comprises moving said first advancing means for a first distance along said second direction, and said transversally moving said additional advancing means comprises moving said additional advancing means for said first distance along said second direction.

17. A non-transitory computer-readable storage medium on which is stored a software product loadable on a control unit of a device for feeding a web of a packaging material towards said application station and which, when executed, implements a method as claimed in claim 9.

18. A device for feeding a web of a packaging material along a path and towards an application station; said packaging material comprising a plurality of areas at which said application station applies, in use, respective opening devices;

the device comprising:

a roller motor connected to a roller to rotatably drive the roller while the roller is in contact with the web to advance the web along a first direction parallel to the path;

a sensor configured to generate a plurality of measure signals associated with positions of the areas of the packaging material; and a first motor operatively connected to the roller and controlled according to at least one of the measure signals to move the roller in a second direction transverse to the path.

19. The device of claim 18, wherein the first motor is also operatively connected to the roller motor to move the roller motor together with the roller in the second direction according to the at least one of the measure signals.

* * * * *